US005921705A

United States Patent [19]

Hodson et al.

[11] Patent Number: 5,921,705

[45] Date of Patent: Jul. 13, 1999

[54] SURFACING BLOCKS

[75] Inventors: Christopher Douglas Hodson, Bromsberroy; Douglas Basil Hodson, Ramsey, both of United Kingdom

[73] Assignee: U.P.S. Limited, Isle of Man, United Kingdom

[21] Appl. No.: 08/727,648

[22] PCT Filed: Apr. 12, 1995

[86] PCT No.: PCT/GB95/00840

§ 371 Date: Dec. 6, 1996

§ 102(e) Date: Dec. 6, 1996

[87] PCT Pub. No.: WO95/28523

PCT Pub. Date: Oct. 26, 1995

[30] Foreign Application Priority Data

Apr. 15, 1994 [GB] United Kingdom ..... 9407485

[51] Int. Cl.[6] ..... E01C 5/06

[52] U.S. Cl. ..... 404/41; 404/42

[58] Field of Search ..... 404/34, 35, 37, 404/38, 41, 42

[56] References Cited

U.S. PATENT DOCUMENTS

| | | | |
|---|---|---|---|
| 4,354,773 | 10/1982 | Noack | 404/41 |
| 4,372,705 | 2/1983 | Atkinson | 405/19 |
| 4,773,790 | 9/1988 | Hagenah | 404/41 |
| 5,054,957 | 10/1991 | Johnson, II | 404/41 |
| 5,251,997 | 10/1993 | Brock | 404/29 |
| 5,449,245 | 9/1995 | Glickman | 404/38 |
| 5,645,369 | 7/1997 | Geiger | 404/34 |

FOREIGN PATENT DOCUMENTS

| | | | |
|---|---|---|---|
| 0063795 | 11/1982 | European Pat. Off. . | |
| 1164888 | 10/1958 | France . | |
| 2398142 | 2/1979 | France . | |
| 2608648 | 6/1988 | France . | |
| 1948744 | 11/1966 | Germany . | |
| 1784497 | 8/1971 | Germany . | |
| 7409912 | 6/1974 | Germany . | |
| 7412669 | 7/1974 | Germany . | |
| 2452475 | 5/1976 | Germany . | |
| 2608871 | 9/1977 | Germany . | |
| 2639747 | 3/1978 | Germany . | |
| 2841261 | 4/1980 | Germany | 404/41 |
| 4222936 | 1/1994 | Germany . | |
| 175824 | 5/1976 | New Zealand . | |
| 194645 | 12/1984 | New Zealand . | |
| 233626 | 5/1925 | United Kingdom . | |
| 254416 | 7/1926 | United Kingdom . | |
| 433742 | 8/1935 | United Kingdom . | |
| 1183489 | 3/1970 | United Kingdom . | |
| 1266437 | 3/1972 | United Kingdom . | |
| 1269624 | 4/1972 | United Kingdom . | |
| 1306465 | 2/1973 | United Kingdom . | |
| 1344995 | 1/1974 | United Kingdom . | |
| 1352353 | 5/1974 | United Kingdom . | |
| 1360247 | 7/1974 | United Kingdom . | |
| 1385207 | 2/1975 | United Kingdom . | |
| 1520274 | 8/1978 | United Kingdom . | |
| 1548604 | 7/1979 | United Kingdom . | |
| 2120699 | 12/1983 | United Kingdom . | |
| 2134561 | 8/1984 | United Kingdom . | |
| 2136348 | 9/1984 | United Kingdom . | |

OTHER PUBLICATIONS

SYMETRY brochure, Interpave Corporation, Cincinnatti, Ohio. (1989).

*Primary Examiner*—James Lisehora

*Attorney, Agent, or Firm*—Kane, Dalsimer, Sullivan, Kurucz, Levy, Eisele and Richard, LLP

[57] ABSTRACT

A surfacing block (1) has upper and lower surfaces (2, 7) bounded by walls (5) extending between the surfaces (2, 7). The surfaces (2, 7) are of a generally cruciform shape having four arms (4) each of which extend in a direction substantially parallel to the lower surface (7) and substantially perpendicular to two of the other arms (4) of the block. The block (1) has around the boundary of its surface projections (8) and/or recesses (9) for interlocking engagement with recesses and/or projections of a neighbouring block. The shape of the block helps to improve the resistance to movement of the block when laid with similar blocks.

35 Claims, 9 Drawing Sheets

SURFACING BLOCKS

The invention relates to blocks which are used principally in the paving of surfaces, for example the surfaces of roads, pavements, driveways and courtyards and in particular to the paving of surfaces subjected to high forces. The invention also relates to clusters of blocks and to blocks for use in the clusters.

Paving, consisting of a plurality of surfacing blocks, should be able to withstand large forces acting upon it. Forces to be withstood include both those caused when heavy loads are placed directly on the paving and those caused by turning loads, for example a turning vehicle. Usually the paving is laid as individual blocks on a bed of sand with joints between the blocks filled with sand or other suitable filling material. On loading, the blocks are able to move small amounts relative to other blocks thereby decreasing the risk of cracking of the blocks. However, blocks laid in that way may be displaced vertically under loading or may creep horizontally under traffic due to the sandfilled joints.

There are improved paving blocks having interlocking surfaces. The interlocking projections and recesses which help to provide "lock up" between blocks, allow an array of blocks to perform as a united load-bearing surface resisting both vertical and horizontal movement of the blocks. The term "lock up" is used for the purpose of this specification to describe a condition in which blocks in the paving become progressively wedged together when the paving is under traffic or subjected to loads thereby increasing the stiffness of the paving. However, in some cases in which the blocks are subjected to large loads, the "lock up" together with other factors have been found to be insufficient to avoid failure of the paving. Failure may take the form of areas of the paving sinking or of blocks creeping horizontally by an undue amount.

It is therefore an object of the invention to provide a block which mitigates the above problems.

According to the invention, there is provided a surfacing block having upper and lower surfaces bounded by walls extending between the surfaces wherein the surfaces are of a generally cruciform shape having four arms each of which extend in a direction substantially parallel to the lower surface and substantially perpendicular to two of the other arms of the block, wherein the block has around the boundary of its surface projections and/or recesses for interlocking engagement with recesses and/or projections of a neighbouring block.

The cruciform blocks have been found to have improved resistance to movement when laid from that of, for example, a rectangular block having a similar distribution of projections and recesses. The arms of the cruciform block stabilise the block and if, for example, a heavy load is exerted unevenly on the block there is increased resistance to lifting compared with a known block since, if an arm of the block begins to lift from the ground, the opposite arm is forced to interlock further with adjacent blocks thus hindering further movement of the block. Resistance to movement of the block, in the form of rotation about an axis perpendicular to the surfaces, is increased when the block is interlocked with other blocks due to the projections and recesses on the arms of the cruciform interlocking with projections and recesses of adjacent blocks and hindering such motion.

Advantageously, the projections and recesses extend through the entire thickness of the block so that the shape of the upper surface is substantially the same as the shape of the lower surface.

Advantageously, the shape of the blocks is such that a number of identical blocks as defined above can be laid with their upper surface uppermost such that there is a substantially constant spacing between the walls of adjacent blocks. In that way, a continuous surface may be formed with each block interlocking with an adjacent block thereby forming a substantially united load-bearing surface.

Advantageously, all of the arms of the cruciform are of substantially the same length. While it is envisaged that blocks of irregular shape could be used, blocks having all of the arms of substantially the same length are more simple to lay as they need not be placed in any particular one of their possible orientations for interlocking with neighbouring blocks. Additionally, if the lengths of the arms are the same, the load distribution across the block is more even.

Advantageously, the block has fourfold rotational symmetry about an axis substantially perpendicular to the lower surface. In that way the block is more simple to lay as explained above.

Advantageously, the length of an arm of the cruciform is substantially the same as the width of the arm.

The dimensions of the block indicated below may be measured by considering the plain cruciform shape from which the block is derived and measuring the relevant dimensions of the cruciform. The dimensions of blocks are usually measured as distances between joint centres, that is the distances between the centres of joints between adjacent blocks when the blocks are laid in an array.

Advantageously, the length of the block is at least 100 mm. If a block which is subjected to large loads is much smaller than that length, it may be pushed into the ground. The smaller the block, the smaller is the area across which the load is distributed. Smaller blocks may be used in areas where they would be subjected to no large loads.

Advantageously, the length of the block is at least 200 mm, preferably about 300 mm. As the size of the block is increased, however, there is an increased risk of cracking of the block and the weight of the block increases. Therefore the length of the block is preferably not greater than 350 mm.

Advantageously, the block has at least one projection and/or at least one recess in each side wall and end wall of each arm. Interlocking engagement with each adjacent block is thus achievable, thereby increasing the resistance to movement of the block.

Preferably, each side wall and end wall of each arm has one recess and one projection which extend a substantially equal distance in opposite directions from the periphery of the cruciform shape. The dimensions of the recess and of the projection are preferably substantially the same.

Advantageously the thickness of the block is between about 50 and 150 mm. Generally, the thicker the block the greater its cost but the greater the load that it can withstand before breaking. Above a certain thickness however, increase in thickness of the block has little effect on the toughness of the block. Preferably the thickness of the block is between about 60 and 100 mm.

Advantageously, there is a pattern of grooves in the upper surface. The pattern may be included for aesthetic reasons and the particular pattern chosen may be used to disguise the shape of the edges of the blocks. In addition, the provision of the grooves may allow dispersion of surface water thus reducing the risk of aqua-planing on the surface.

The pattern may be in the form of a grid of grooves which give the illusion that the paving is formed from a number of smaller blocks. Preferably the grooves are between about 20 mm and 200 mm apart. The grid may be a grid of squares having length of, for example, 40 mm or 80 mm.

The actual block may be provided with a chamfer around the edge of the upper surface of the block.

There may also be provided edge blocks which are formed from a section of a block as defined above and which have a straight edge along one side of the block and so may be used at the periphery of the paved surface.

The spaces between the blocks in an array of blocks may be filled using sand or other suitable material.

It is to be understood that where reference is made to the dimensions of the block, the shape of the block, the configuration of the block and to the cruciform shape of the block, except where from the context it is clearly otherwise, the reference is in respect of a notional block having edges at the joint centres between the actual blocks.

The size of joint between the actual blocks is usually about 3 mm and the shape of the actual block will be designed to take account of the joint. Therefore, for blocks laid having a joint of 3 mm between the actual adjacent blocks, the actual edge of the block would be about 1.5 mm from the joint centre between actual blocks. The corners of the actual block may be rounded.

Paving may be laid by laying clusters of a number of blocks as one unit using a machine with clamps which places one cluster alongside others. However, in order to lay the clusters quickly and easily, effectively straight edges and lines of weakness are often created in the paving where there is little interlock between blocks. The present invention seeks to mitigate that problem.

According to another aspect of the invention, therefore, there is also provided a cluster of surfacing blocks including at least two cruciform blocks as defined above, the blocks being arranged in the cluster such that the surface of a block is substantially coplanar with the corresponding surface of an adjacent block.

Clusters of blocks containing cruciform blocks interlock effectively with blocks of adjacent clusters without creating lines of weakness in the resulting paving. The cruciform block is particularly advantageous for use in such clusters as, without attachment means provided between the blocks, a cluster of blocks may be lifted by, for example, gripper arms which press against two opposite sides of the cluster and the blocks will remain held together by friction. Especially advantageous is the case in which the cruciform blocks in the cluster have dimensions such that the length of the arms equals the width of the arms, so that the orientation of the cruciform blocks in a cluster consisting of a linear array of rows of blocks is such that the direction along the length of the block is in a direction which is not substantially parallel to the direction along the length or width of the cluster. The machine holding the cluster will thus exert a turning force on the blocks, thereby increasing the extent of the interlocking engagement. Those clusters are stable and may be lifted and transported without the cluster falling apart. Clusters of cruciform blocks may be placed in position by dropping the clusters vertically downwards into a position in which the clusters interlock with adjacent clusters.

Advantageously, at least a major proportion of the blocks are cruciform blocks as defined above. If the blocks are to be used in a surface which is subjected to large loads, the maximum advantage of using the cruciform blocks may be achieved by laying the surface using mainly cruciform blocks (the term "cruciform blocks" includes the modified cruciform blocks described below). Clusters of cruciform blocks do not have effectively straight joints nor create lines of weakness between the clusters when a number of clusters are laid adjacent to each other. There may be provided edge blocks which have the dimensions of a section of a block and have a straight edge so that the straight section may be placed at the periphery of the paved area. It is possible that the edge blocks could be laid as part of a cluster of blocks.

The blocks may all be cruciform blocks.

Advantageously there is a substantially constant spacing between the walls of adjacent blocks such that there is interlocking between the blocks.

It would be possible to use clusters comprising two blocks, the blocks being laid by hand or using a machine but preferably the cluster contains at least four blocks.

Advantageously the cluster contains rows of blocks each comprising the same number of blocks. The cluster may contain eight blocks as two rows of four blocks, or it may contain for example twelve blocks, sixteen blocks or more.

Advantageously each block in a cluster is separate from the other blocks. The blocks are thus not connected together and therefore the final surface is substantially as if each block had been laid individually.

Advantageously the cluster contains at least one modified block. Since the blocks interlock, it may be difficult to introduce blocks to the side edges of a surface which has been partly laid if all the blocks are identical, especially if the surface is laid in clusters using a machine.

Advantageously the modified block has fewer projections and/or fewer recesses than an unmodified block. In that way, the interlocking between modified blocks is reduced and the cluster may be laid more easily. So that the advantages gained by increasing the interlocking between the blocks are not lost, modified blocks are only provided on one or two of the shorter sides of the cluster and the laying strategy adjusted accordingly to avoid effectively straight joints between clusters extending across the paving. Fewer modified blocks will be required in a given area if the blocks are laid as larger clusters and therefore large clusters are to be favoured if modified blocks are to be used.

Advantageously, the cluster contains two different types of modified block at opposite ends of the cluster, the shapes of the two different modified blocks being such that the first modified block and the second modified block can be laid adjacent to each other, the resulting shape of the two blocks being substantially the same as the shape of two adjacent unmodified blocks. The final appearance of the surface is therefore as if the surface contained no modified blocks, except of course that the configuration of the joints between blocks is different in some regions of the surface.

Advantageously one end of the cluster comprises first modified blocks and the opposite end of the cluster comprises second modified blocks. If one type of modified block is at one end of the cluster, and another type at the opposite end, the clusters are simple to lay since the first modified blocks can be easily located to engage with the second modified blocks of an adjacent cluster.

The invention also provides a modified block for use in a cluster defined above. The shape of the first and second modified blocks may be formed by removing a section of an arm of the cruciform from the first modified block and adding that section to the second modified block. Of course, the second modified block when made is formed as a one piece block.

The invention also provides a method for laying an array of surfacing blocks, the method including the step of laying a plurality of clusters as defined above over an area.

Advantageously, when clusters containing modified blocks are laid, the clusters are laid such that a joint between modified blocks of adjacent clusters is not adjacent a joint between modified blocks of other adjacent clusters. The joints between modified blocks could create a line of weakness in the paving, and so those joints are staggered.

There is also provided the use of a cluster as defined above in the laying of an array of surfacing blocks.

There is also provided an array of surfacing blocks, the array comprising blocks as defined above. Advantageously in the array of surfacing blocks, the spacing between walls of adjacent blocks is less than 10 mm. There is therefore little movement of the blocks about their laid position. Advantageously, the spacing between walls of adjacent blocks is between 1 and 5 mm, preferably about 3 mm. The space between the blocks is preferably filled with sand or other suitable filling material.

There is also provided an array of surfacing blocks, the array comprising a plurality of clusters as described above. Advantageously the clusters are laid such that a joint between modified blocks of adjacent clusters is not adjacent a joint between modified blocks of other adjacent clusters. That reduces the possibility of lines of weakness in the array as described above.

According to the invention there is also provided a surfacing block having an upper surface and a lower surface and walls extending between the surfaces, the block having at least three arms extending in the plane of the block, at least one arm being substantially perpendicular to two of the other arms wherein the boundary of the surfaces have projections and recesses, the dimensions of the projections and recesses enable interlocking of the block with an adjacent block there being a substantially constant spacing between the walls of adjacent blocks.

According to the invention there is also provided a cluster of at least three surfacing blocks, the blocks having upper and lower surfaces bounded by walls extending between the surfaces, the blocks being arranged in the cluster with the lower surface of one block substantially coplanar with the lower surface of an adjacent block, the cluster having around the boundary of its surface projections and/or recesses for interlocking engagement with recesses and/or projections of neighbouring clusters, wherein the cluster includes modified blocks in at least two sides of the cluster, the shape of the modified blocks being such that the boundary of the cluster is modified to facilitate positioning of the cluster adjacent to a similar cluster.

Advantageously the boundary of the cluster is modified such that even when a plurality of clusters are laid adjacent to one another there are no re-entrant recesses in the boundary of the clusters.

The modified blocks may have fewer projections and/or recesses around the boundary of its surface than an equivalent unmodified block.

Advantageously each of the blocks in the cluster has at least two arms extending in a direction parallel to the lower surface of the block, the arms being perpendicular to each other. The blocks may be of a generally cruciform shape.

Embodiments of the invention will now be described by way of example, with reference to the accompanying drawings, of which:

FIG. 1*a* shows a plan view of the upper surface of a surfacing block

FIG. 1*b* shows a view from the side of and below the block

Figure 5A:
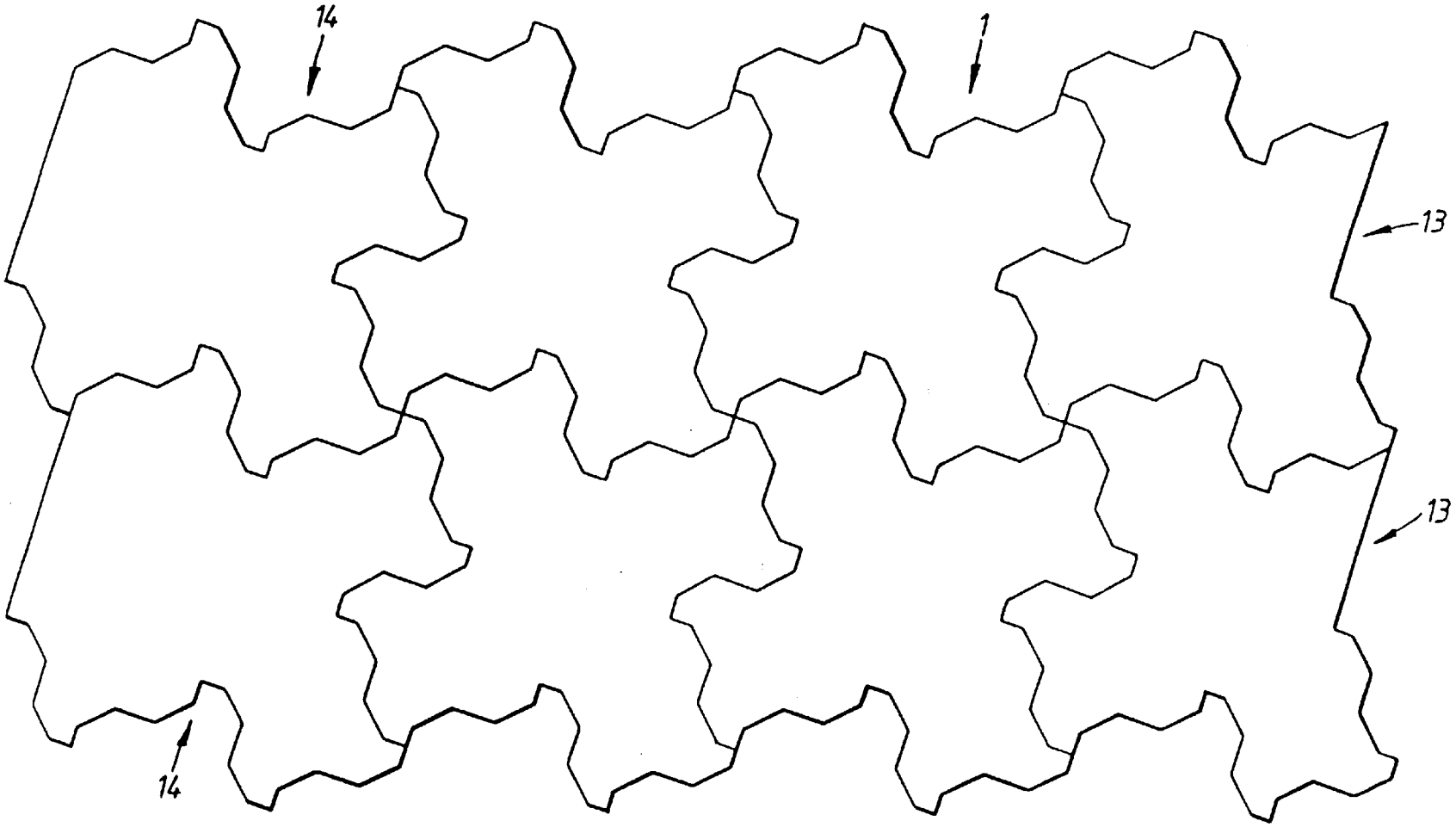

FIG. 5*a* shows a cluster containing modified blocks

Figure 5B:
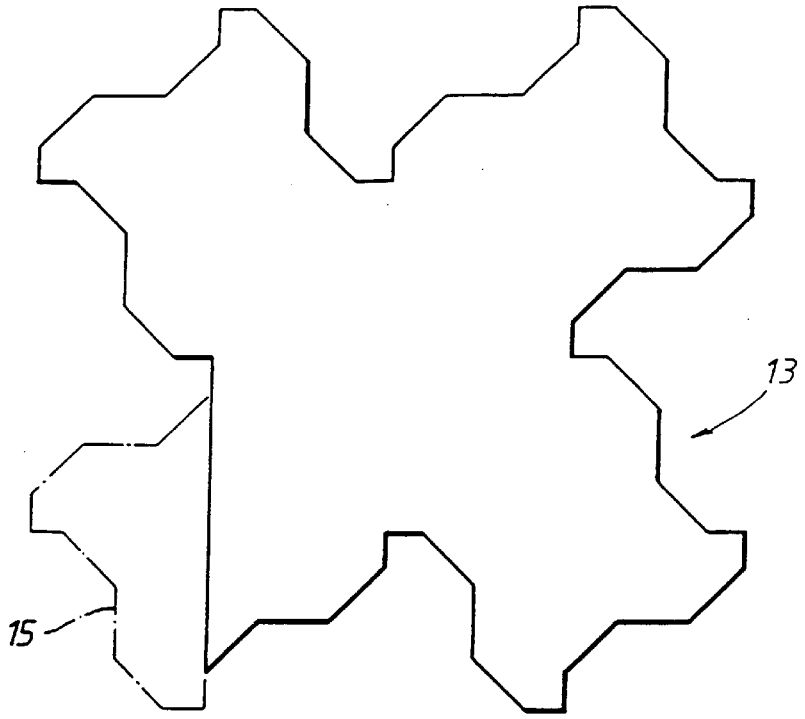

FIG. 5*b* shows a first modified block

Figure 5C:
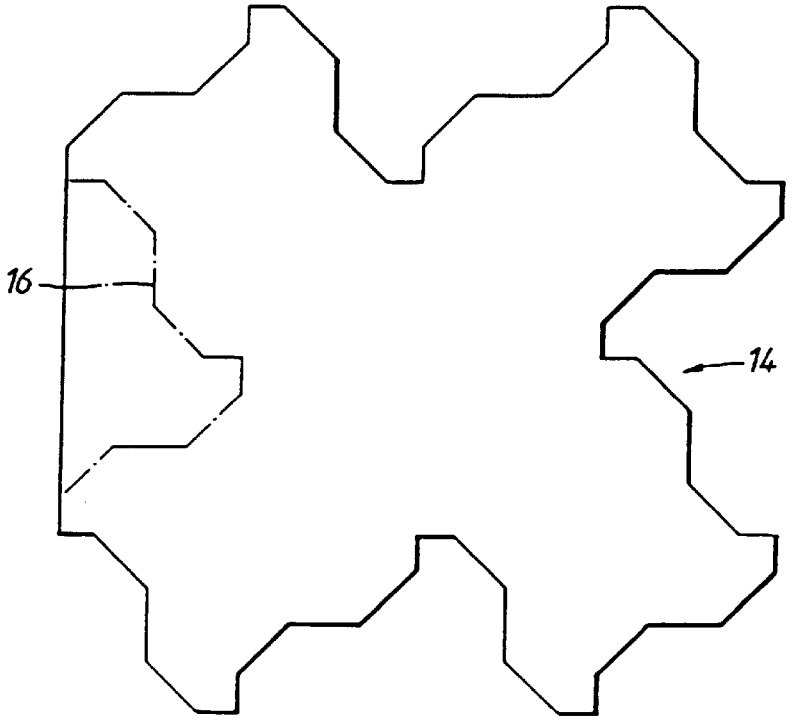

FIG. 5*c* shows a second modified block

Figure 6:
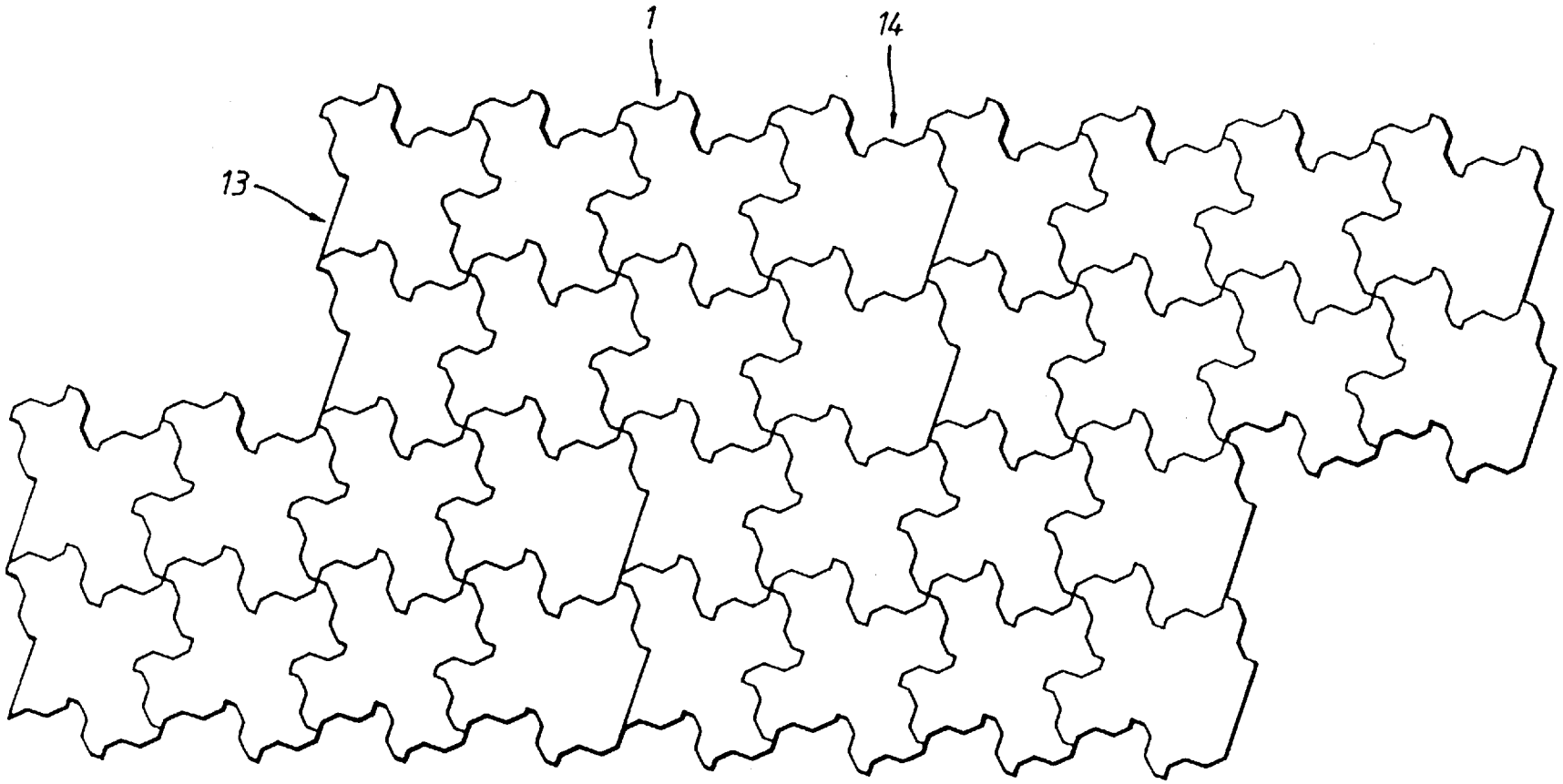

FIG. 6 shows an array of clusters containing modified blocks

Figure 7:
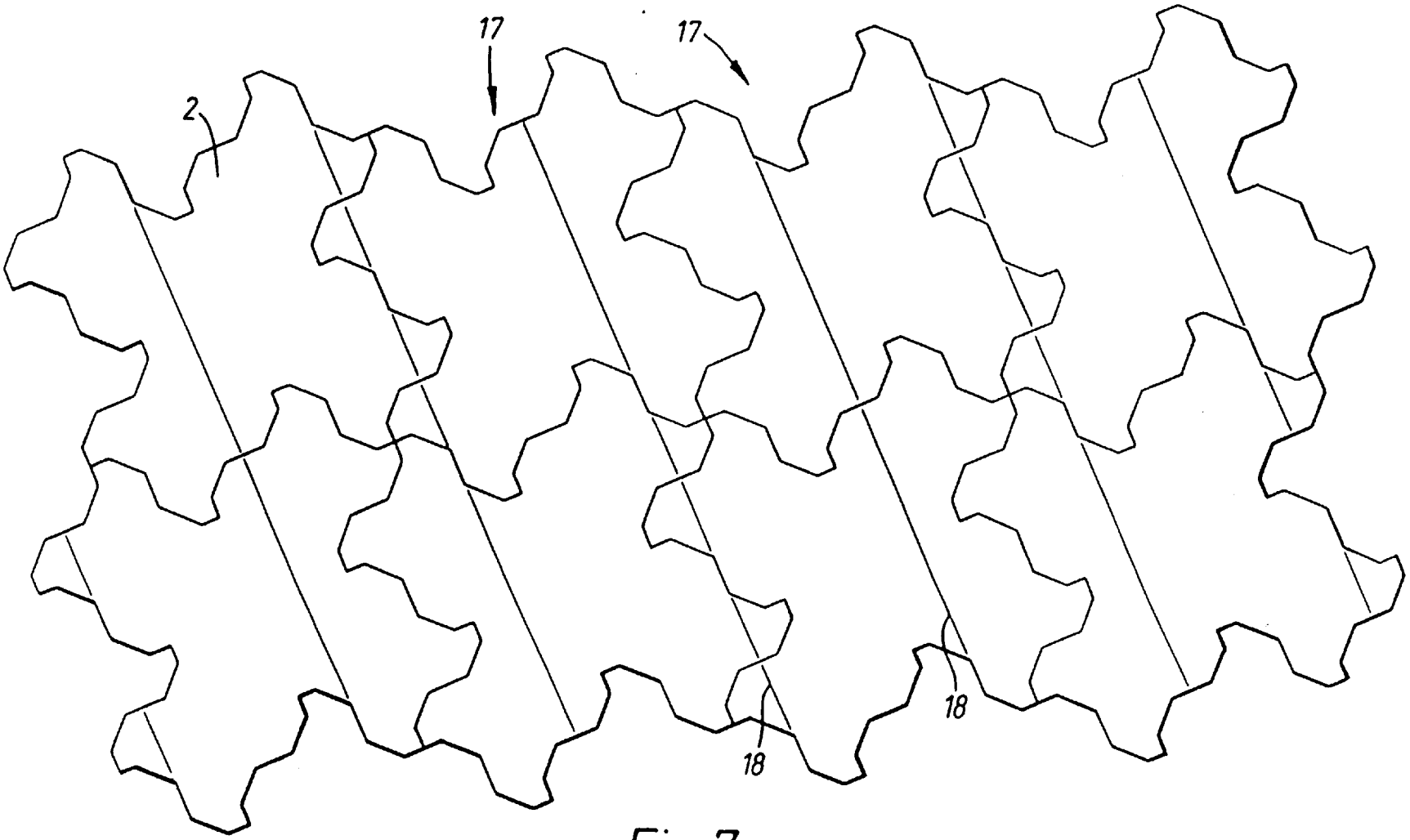

FIG. 7 shows a cluster of blocks having a surface pattern

Figure 8:
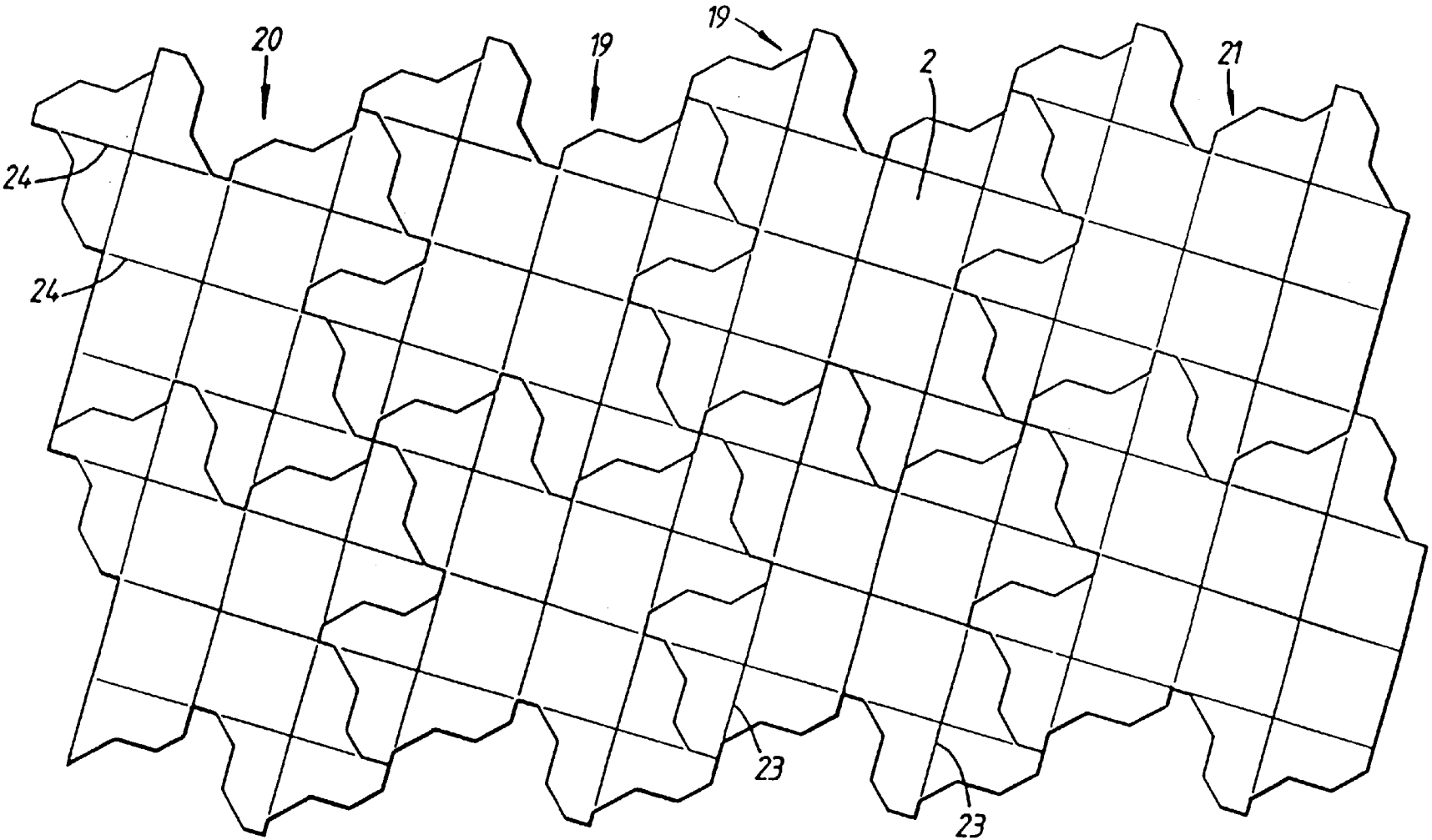

FIG. 8 shows a cluster of blocks having a surface pattern, the array including modified blocks.

The shapes of the blocks shown in the Figures is shown as the shape of the joint centres between blocks when the blocks are laid in an array, unless it is stated to the contrary.

Figure 1A:
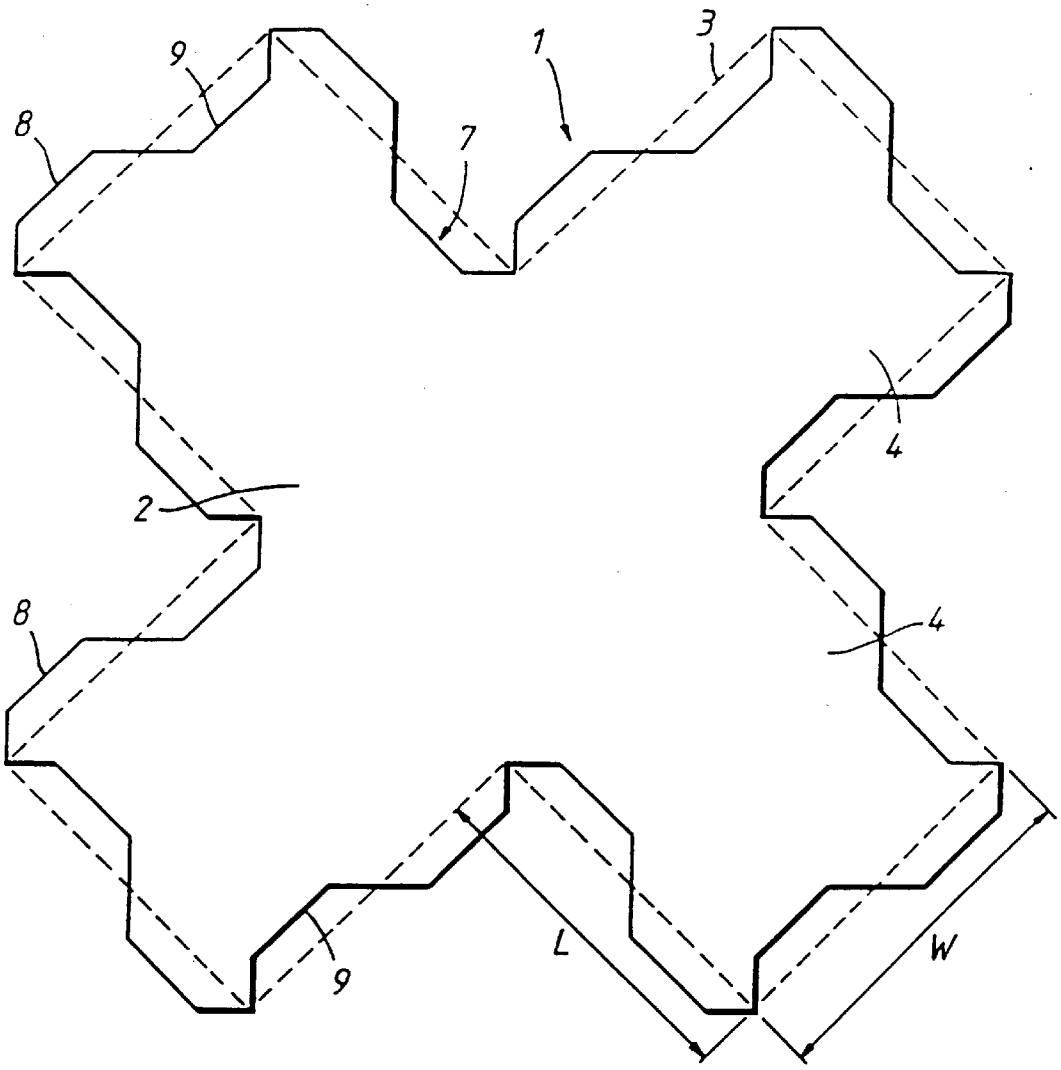
Figure 1B:
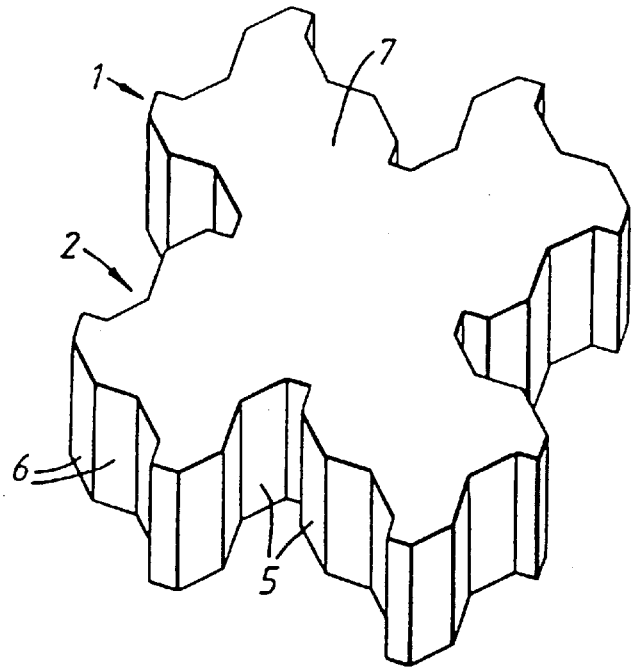

FIG. 1*a* shows a surfacing block 1. The view of the block is of the upper surface 2 and shows that the block has a generally cruciform shape. The outline of the cruciform from which the shape of the block is derived is shown in FIG. 1*a* by a broken line 3. The block 1 has four arms 4 which are coplanar and are perpendicular to each other. In the block shown in FIG. 1, the length l of each arm of the cruciform is equal to the width w of each arm. FIG. 1*b* is a view from the side of the block and shows side walls 5 and end walls 6 of the arms extending between the upper surface 2 and the lower surface 7. The walls are substantially perpendicular to the upper and lower surfaces 2, 7, as can be seen from FIG. 1*b*. The upper edges of the block may be chamfered.

The block 1 has projections 8 and recesses 9 around the entire periphery of the surfaces 2, 7. In relation to the cruciform 3 the dimensions of a projection is the same as that of a recess. As shown in FIG. 1*a,* the recess 9 is outwardly flared and has a plane inner face and plane sides and is flanked by an inwardly flared projection 8 which has a plane outer end and plane sides. The width of the projection and the recess together when measured at the broken line 3 is equal to the length of the arm and to the width of the arm of the cruciform. As shown in FIG. 1*a,* the arrangement of projections and recesses is such that the arrangement is the same for each arm of the cruciform.

The projections and recesses extend through the entire thickness of the block and therefore the shape of the upper surface of the block is the same as that of the lower surface.

Figure 2:
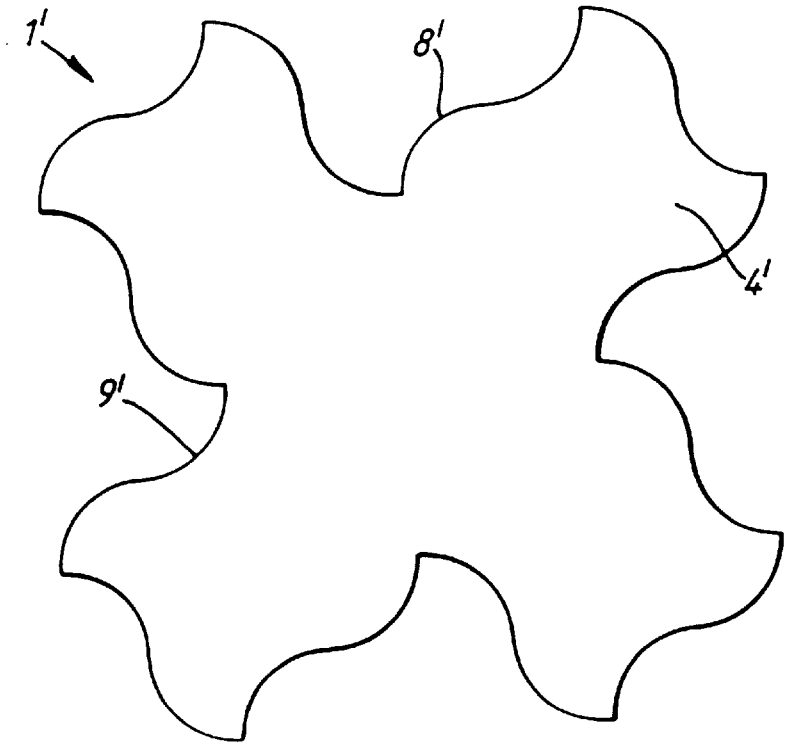
FIG. 2 shows a view of the upper surface of a surfacing block having an alternative shape

FIG. 2 shows a block 1' having a different arrangement of projections 8' and recesses 9'. The shape of the periphery is approximately a sine wave having a wavelength equal to the length of an arm 4' of the cruciform.

Figure 3:
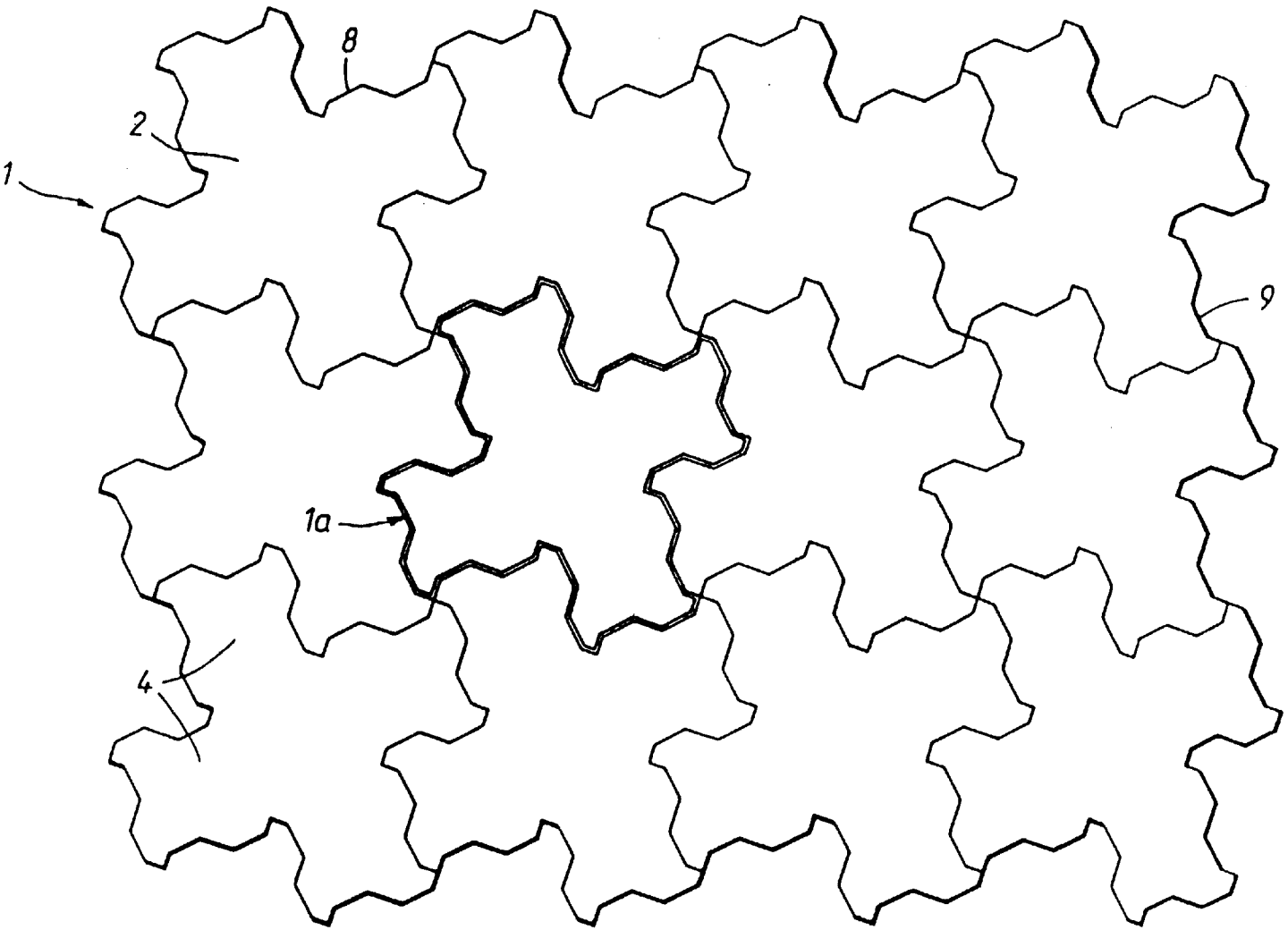
FIG. 3 shows a plan view from above of an array of blocks, the blocks having the configuration of the block shown in FIGS. 1*a* and 1*b*

In one embodiment of the invention in which the blocks are used to pave an area of ground, the ground is first levelled and if necessary prepared to provide a firm base on which the blocks will lie. Usually a bed of sand is prepared on the ground in which the blocks will be laid. The blocks are then laid over the area in an interlocking manner as indicated in FIG. 3. Adjacent walls of neighbouring blocks are spaced apart by a distance of about 3 mm to receive sand or other suitable material and the precise dimensions of the blocks should be chosen to allow for such joints. The actual shape of a block is shown as 1*a* in FIG. 3. The surface shown in FIG. 3 consists of blocks all of the same configuration, that configuration being that shown in FIGS. 1*a* and 1*b*. A similar surface could be constructed using blocks of the configuration shown in FIG. 2.

In the example described, the lengths of the arms 4 of the cruciform 3 are 112.5 mm and are equal to the widths of the cruciform 3 and a block will have a mean length of about three arms lengths. Those dimensions are measured relative to joint centres between blocks. The thickness of the block, that is the perpendicular distance between the upper and lower surfaces will depend on the application for which the surface is laid.

The blocks are made from concrete and are formed in moulds using standard production techniques.

Figure 4:
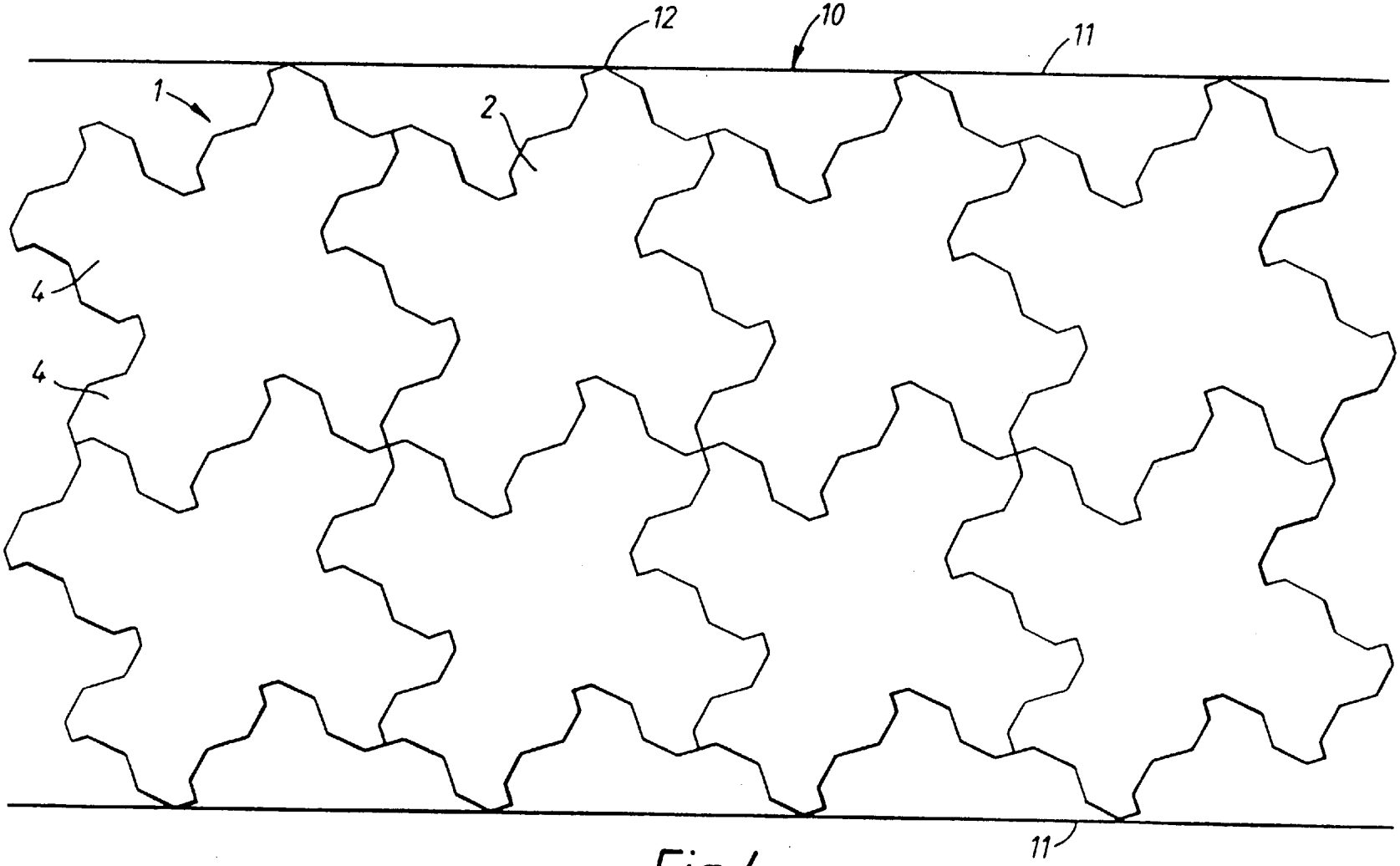
FIG. 4 shows a cluster of eight blocks

In a further embodiment of the invention, the blocks may be laid in clusters of individual blocks. FIG. 4 shows a cluster of eight blocks. The blocks are arranged as a linear array of four pairs of blocks. A pair of clamps 11 is used to lift the cluster and to move it to the area to be paved. The clamps may be bars of any suitable material. The clamp exerts a force on the cluster through the contact points 12 of the blocks; the force holds the blocks together. Due to the dimensions of the blocks in the cluster, the direction along a pair of arms 4 of the block 1 lies neither parallel nor perpendicular to the sides 10 of the cluster and thus the pressure exerted by the clamps tends to rotate the block about an axis perpendicular to its surface. That rotation is prevented by blocks adjacent to the block and "lock up" occurs. The blocks remain securely interlocked together for as long as the force is exerted by the clamps.

The ground on which the surface is to be laid may first be prepared as described above.

The cluster may be moved in the clamps to the relevant position and lowered into interlocking engagement with blocks already laid.

FIG. 5*a* shows a cluster of blocks similar to that of FIG. 4 but including a pair of first modified blocks 13 at one end of the cluster and a pair of second modified blocks 14 at the opposite end of the cluster. FIG. 5*b* shows that the first modified block 13 has the same shape as an unmodified block 1 except that approximately half of one arm of the block has been removed diagonally. The broken line 15 shows the outline of an unmodified block. The second modified block 14 shown in FIG. 5*c* has the same shape as the unmodified block except that a section of equivalent shape to that removed for the first modified block is added to the block. The broken line 16 shows the outline of an unmodified block.

FIG. 6 shows how clusters containing modified blocks may be laid adjacent to similar clusters. The cluster is moved using the clamps gripping the upper part of blocks at the periphery of the cluster so that lower parts may be located touching the edges of the upper parts of blocks of an adjacent cluster. The cluster is then slid along the walls of the blocks of the adjacent cluster to its intended position and released from the clamps onto the sand base.

FIG. 7 shows a cluster of unmodified blocks 17 having a pattern of parallel grooves 18 on its upper surface 2. The distance between the grooves may be 160 mm as shown in the Figure, or may be 80 mm. It can be seen from FIG. 7 that the pattern of grooves to some extent hides the position of the edges of the blocks. The blocks 17 having a surface pattern do not in general have chamfered edges as the chamfers tend to highlight the position of the edges.

FIG. 8 shows a cluster of blocks 19 containing modified blocks 20 and 21. The upper surfaces 2 of the blocks have a first set of parallel grooves 23 and a second set of parallel grooves 24, the sets of grooves forming a grid of squares on the upper surface 2. The separation of the grooves 23 and the separation of the grooves 24 are each about 80 mm. It can be seen from FIG. 8 how the pattern of lines disguises the edges of the modified blocks 20 and 21.

Whilst FIGS. 1*a* and 2 show two different forms of edge for the blocks it will be understood that there are also other possible forms: for example, the shape of the upper surface could be as shown in FIG. 2 but with straight lines extending between the peaks, midpoints and troughs of the sine wave, instead of curves to form a triangular wave.

Throughout the description reference is made to paving blocks. At least in the United Kingdom the term "paving block" is usually employed for smaller paving units and the term "paving slab" employed for larger units. Usually the division is set at paving units having a length of about 300 mm. In the present specification the use of the term "paving block" is not to be taken as implying that the overall length of the unit is less than 300 mm.

We claim:

1. A surfacing block having upper and lower surfaces bounded by walls extending between the surfaces, the surfaces being of a generally cruciform shape having four arms each of which extends in a direction substantially parallel to the lower surface and substantially perpendicular to two of the other arms of the block, the width of each arm being substantially the same as the length of the arm and each wall of each arm having one projection and one recess extending in opposite directions from the periphery of the cruciform shape for interlocking engagement with recesses and projections of a similar block, each projection and recess having substantially matching dimensions and comprising a plane end face bounded by a pair of plane side faces which are outwardly flared from the end face and which are separated by a distance of substantially half of the length of the arm.

2. A surfacing block according to claim 1 wherein the shape of the block is such that a number of identical blocks can be laid with their upper surface uppermost such that there is a substantially constant spacing between the walls of adjacent blocks.

3. A surfacing block according to claim 1 wherein all of the arms of the cruciform are of substantially the same length.

4. A surfacing block according to claim 3 wherein the block has fourfold rotational symmetry about an axis substantially perpendicular to the lower surface.

5. A surfacing block according to claim 1 wherein the length of the block is at least 200 mm.

6. A surfacing block according to claim 5 wherein the length of the block is about 300 mm.

7. A surfacing block according to claim 1 wherein the length of the block is less than 350 mm.

8. A surfacing block according to claim 1 wherein each recess and projection extend a substantially equal distance in opposite directions from the periphery of the cruciform shape.

9. A surfacing block according to claim 1 wherein the thickness of the block is between about 60 and 100 mm.

10. A surfacing block according to claim 1 wherein there is a pattern of grooves in the upper surface.

11. A surfacing block according to claim 10 wherein the pattern is a grid of grooves.

12. A cluster of surfacing blocks including at least two cruciform blocks as defined in claim 1, the blocks being arranged in the cluster such that the surface of a block is substantially coplanar with the corresponding surface of an adjacent block.

13. A cluster of surfacing blocks according to claim 12 wherein at least a major proportion of the blocks are cruciform blocks.

14. A cluster of surfacing blocks according to claim 13 wherein all of the blocks are cruciform blocks.

15. A cluster of surfacing blocks according to claim 12 wherein there is a substantially constant spacing between the walls of adjacent blocks.

16. A cluster of surfacing blocks according to claim 12 wherein the cluster has no effectively straight edges.

17. A cluster of surfacing blocks according to claim 12 wherein the cluster contains at least four blocks.

18. A cluster of surfacing blocks according to claim 17 wherein the blocks are in an array of rows of blocks, each row containing the same number of blocks.

19. A cluster of surfacing blocks according to claim 17 wherein the cluster contains at least eight blocks.

20. A cluster of surfacing blocks according to claim 12 wherein each block in a cluster is separate from the other blocks.

21. A cluster according to claim 12 wherein the cluster contains at least one modified block.

22. A cluster according to claim 21 wherein the modified block has fewer projections and/or fewer recesses than an unmodified block.

23. A cluster according to claim 21 wherein the cluster contains two different types of modified block at opposite ends of the cluster and the shapes of the two different modified blocks are such that a first modified block and a second modified block can be laid adjacent to each other such that the resulting shape of the two blocks is substantially the same as the shape of two adjacent unmodified blocks.

24. A cluster according to claim 21 wherein one end of the cluster comprises only first modified blocks and the opposite end of the cluster comprises only second modified blocks.

25. A modified block for use in a cluster according to claim 21.

26. A cluster according to claim 21 wherein the cluster includes modified blocks in at least two sides of the cluster, the shape of the modified blocks being such that the boundary of the cluster is modified to facilitate positioning of the cluster adjacent to a similar cluster.

27. A cluster according to claim 26 wherein each of the blocks in the cluster has at least two arms extending in a direction parallel to the lower surface of the block, the arms being perpendicular to each other.

28. A method for laying an array of surfacing blocks, the method including the step of laying a plurality of clusters according to claim 12 over an area.

29. A method according to claim 28 including the step of laying a plurality of pairs of clusters, each pair of clusters comprising a first cluster having a first modified block and a second cluster having a second modified block, the first and second clusters being laid such that the first modified block is laid adjacent to the second modified block to define a joint between the first and second modified blocks of the pair of clusters, wherein the pairs of clusters are laid such that the joint between the first and second modified blocks of one pair of clusters is not adjacent the joint between the first and second modified block of another pair of clusters.

30. An array of surfacing blocks, the array comprising a plurality of clusters as defined in claim 12.

31. An array according to claim 30, the array comprising a plurality of pairs of clusters, each pair of clusters comprising a first cluster having a first modified block and a second cluster having a second modified block, the first and second clusters being arranged such that the first modified block is adjacent the second modified block to define a joint between the first and second modified blocks of the pair of clusters, wherein the pairs of clusters are laid in the array such that the joint between the first and second modified blocks of one pair of clusters is not adjacent the joint between the first and second modified blocks of another pair of clusters.

32. An array of surfacing blocks, the array comprising blocks as defined in claim 1.

33. An array of surfacing blocks according to claim 32 wherein the spacing between walls of adjacent blocks is less than 10 mm.

34. An array of surfacing blocks according to claim 33 wherein the spacing between walls of adjacent blocks is between 1 and 5 mm.

35. An array of surfacing blocks according to claim 34 wherein the spacing between walls of adjacent blocks is about 3 mm.

* * * * *